US009886846B2

(12) United States Patent
Mitra

(10) Patent No.: US 9,886,846 B2
(45) Date of Patent: Feb. 6, 2018

(54) SYSTEMS AND METHODS FOR CONFIGURING A REMOTE CONTROL TO CONTROL MULTIPLE DEVICES

(71) Applicant: EchoStar Technologies L.L.C., Englewood, CO (US)

(72) Inventor: Shounak Mitra, Englewood, CO (US)

(73) Assignee: EchoStar Technologies L.L.C., Englewood, CO (US)

( * ) Notice: Subject to any disclaimer, the term of this patent is extended or adjusted under 35 U.S.C. 154(b) by 0 days.

(21) Appl. No.: 14/684,080

(22) Filed: Apr. 10, 2015

(65) Prior Publication Data

US 2016/0300480 A1 Oct. 13, 2016

(51) Int. Cl.
*G08C 17/02* (2006.01)
*G08C 23/04* (2006.01)

(52) U.S. Cl.
CPC ..... *G08C 17/02* (2013.01); *G08C 23/04* (2013.01); *G08C 2201/20* (2013.01); *G08C 2201/92* (2013.01)

(58) Field of Classification Search
None
See application file for complete search history.

(56) References Cited

U.S. PATENT DOCUMENTS

2005/0200499 A1* 9/2005 Di Peppe ..... G08C 23/04 340/870.28
2011/0254683 A1 10/2011 Soldan et al.
2013/0147612 A1* 6/2013 Hong ..... G08C 19/00 340/12.54

OTHER PUBLICATIONS

FrontierTM TV P265v3 Remote Control Manual, Jul. 8, 2010, Entire Document.*
Saito et al., "Smart Baton System: A Universal Remote Control System in Ubiquitous Computing Environment," *IEEE International Conference on Consumer Electronics*, Los Angeles, CA, USA, Jun. 17-19, 2003, pp. 308-309. (3 pages).

* cited by examiner

*Primary Examiner* — Daniell L Negron
(74) *Attorney, Agent, or Firm* — Seed Intellectual Property Law Group LLP

(57) ABSTRACT

Systems and methods are disclosed for using a single remote control to control a particular device among several devices by aiming the remote control at the device to identify the device to be controlled. Once the device is identified, the remote control is then configured to send remote control commands to communicate with the identified device when the buttons or other user interface elements on the remote control are selected.

20 Claims, 7 Drawing Sheets

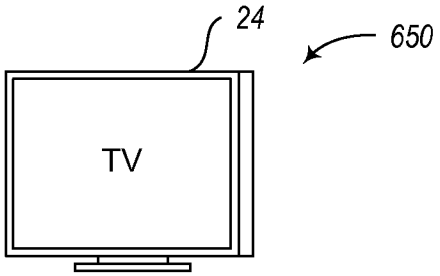
FIG. 2C
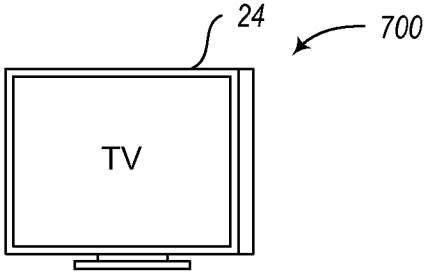
FIG. 2D
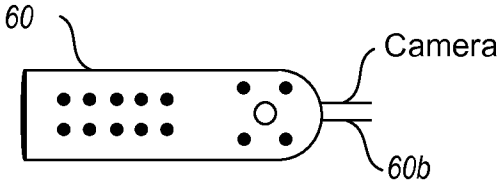
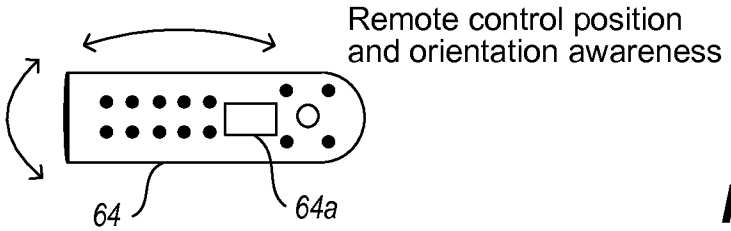

SYSTEMS AND METHODS FOR CONFIGURING A REMOTE CONTROL TO CONTROL MULTIPLE DEVICES

BACKGROUND

Technical Field

The present disclosure relates to the field of audiovisual entertainment viewing and, in particular, to configuring a remote control that controls multiple components of an audiovisual entertainment system.

Description of the Related Art

Remote controls are typically used to control component devices of an audiovisual entertainment system. These devices include a television display, set-top box, digital video recorder, videocassette recorder, sound system and the like. Users have typically had to use individual remote controls to control each separate device. More recently, universal remote controls allow a user to control multiple devices from one single universal remote control. This is typically done by configuring the different modes of the universal remote control to correspond to different devices. When the universal remote control is in one particular mode, for example a "television" mode, the buttons on the remote control, when pressed, send remote control commands that are received by the television. Switching the universal remote control to "DVR" mode will similarly send commands to the digital video recorder, and so on.

BRIEF SUMMARY

Systems and methods are disclosed for using a single remote control to control a particular device among several devices by aiming the remote control at the device to identify the device to be controlled. Once the device is identified, the remote control is then configured to send remote control commands to communicate with the identified device when the buttons on the remote control are pressed.

These systems and methods provide a user with a more intuitive way to use remote controls by enabling the remote control to determine what device it is controlling by what device it is aimed at. This is done without requiring the viewer to press a device selection or mode selection button on the remote control.

For example, if a user wants to turn up the television volume, the user points the remote control at the television. The remote control identifies that it is pointing at the television and the volume up button on the remote control is configured to send the volume up command to the television. If the user wants to start playing a digital video disk in a digital video disk player, the user points the remote control at the digital video disk player. The remote control identifies that it is pointing at the digital video disk player and the play button on the remote control is then configured to send the remote control command to play the video disk when the play button is pressed.

After the remote control identifies the device at which it is pointed, the remote control is then configured to control the identified device by associating commands to control the identified device with the buttons or other input mechanisms on the remote control. This way the viewer will easily know, by where the remote control is aimed, whether pressing a channel change button on the remote control will change channels on the television rather than change song playback selections on a digital video disk player. In some implementations, not all commands available to control the device may be mapped to each remote control button.

In one example implementation, a user is sitting in a living room, watching a television program streamed to a set-top box that is connected to a television display and a digital video recorder. The set-top box is receiving streamed audiovisual content from a content provider such as DISH®. If the user wants to change the channels on the television, the user points the remote control at the television display and presses the channel controls on the remote control. This will cause the television to change channels. If the viewer then points the remote control at the set-top box and presses the channel controls on the remote control, the channel will change on the set-top box.

While continuing to point at the set-top box, pressing the "play" button on the remote control may start playing a video-on-demand program controlled by the set-top box. If the viewer then points the remote control at the digital video recorder, pressing the "play" button on the remote control would then start playing a recorded video program on the digital video recorder.

These systems and methods also apply to other devices that can be controlled by a remote control. For example, household items such as curtains, shades, lights, fireplaces and garage doors may be controlled by a single remote control by pointing the remote control at the device the user wishes to control. In some implementations, the remote control may be personal to a user, for example a key fob having a minimum number of buttons.

In one implementation, each controlled device identifies itself to a remote control using a transmitter on the device to send identifying signals to the remote control. These signals may include infrared, radio-frequency and ultrasound signals. The device may also send other data to the remote control, for example information about what controllable features are present on the device and the commands to control these features. The remote control includes a directional receiver used to determine which device the remote control is pointed at and to receive information about that device. Receivers on the remote control may include directional antennas, low-resolution cameras, or infrared detectors with optics to limit the field of view. Once the remote control has determined what device it is pointed at, the remote switches configurations, as well as any user interface features of the remote control, to be able to communicate with the identified device. From the user's perspective, the remote control seamlessly switches control to whatever device at which the remote control is pointed.

In some implementations, after the user points the remote control at a device to configure the remote control for that device, the user can then indicate, for example by pressing a button on the remote control, that the remote control should remain configured for that device for a certain period of time. The period of time may be associated with an elapsed period of time, an indication by the user such as the pressing of another button on the remote control, or by a sequence of actions by the user such as a specific sequence of commands the user issues from the remote.

In other implementations, the commands available to the remote are limited to a subset of functions the device is able to perform. For example, if the remote control is pointed at a television, commands for changing channels and volume would be enabled in the remote control but play, stop, fast-forward and reverse would not be enabled. If the remote control is pointed at a digital video disk player, then play, stop, fast-forward and reverse controls would be enabled but commands for selecting particular channels would be disabled. The command to change channels may instead be a command to immediately advance the next scene selection on the digital video disk.

In other implementations, the remote control is configured based on the function that a user would expect to be performed by that device, rather than what the device is actually capable of doing. In variations of these implementations, the device at which the remote control is pointed would receive a command from the remote control and then send that command to the appropriate device for execution. For example, the user may want to increase the volume of a television program and point the remote control at the television displaying the program even though the television is a monitor only without any built-in speakers. In these implementations, if the volume is actually controlled by a stereo amplifier housed in a different device, the television would route that received remote control command to the stereo amplifier. In some variations, this function may be performed using the HDMI-CEC protocol.

The remote control may be configured to operate with several devices in a number of different ways. For example, in one implementation the remote control receives a set of commands and mapping of those commands to remote control buttons from the identification signal sent by the beacon on the identified device. In another implementation, the remote control receives commands and a mapping of those commands to remote control buttons from the user in a manner similar to programming a universal remote control with multiple modes that correspond to multiple devices that may be controlled. In variations of this implementation, when the remote control identifies a device, it will put the remote control into the mode that matches the identified device. In yet another implementation, the remote control includes the ability to communicate remotely with a system that has a database library of stored mappings of commands to remote control buttons for multiple devices.

BRIEF DESCRIPTION OF THE SEVERAL VIEWS OF THE DRAWINGS

FIG. 2C shows a diagram of one implementation of a remote control identifying a device at which the remote control is pointed by using a camera within the remote control to capture an image of the device.

FIG. 2D shows a diagram of one implementation of a remote control that uses position and orientation awareness of the remote control to identify the device at which the remote control is pointed.

DETAILED DESCRIPTION

Figure 1:
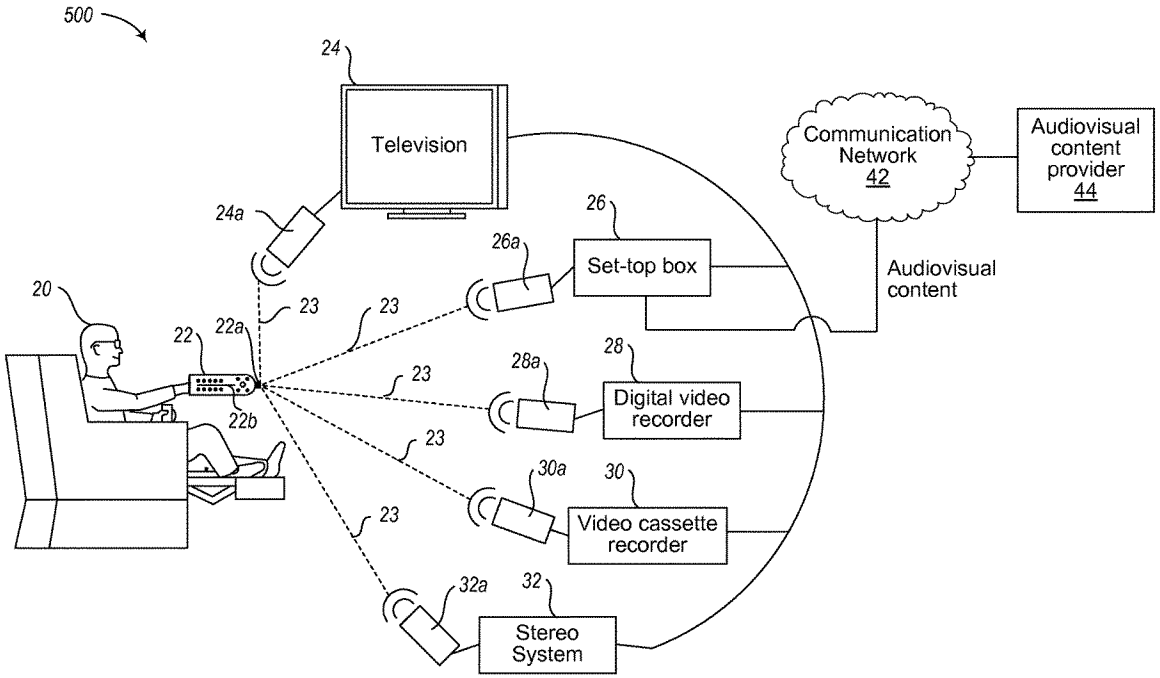
FIG. 1 shows a diagram of one implementation of a system for configuring a remote control to control multiple devices for a home entertainment system.

FIG. 1 shows diagram 500 of one implementation of a system for configuring a remote control to control multiple devices in a home entertainment system. In this implementation, a user 20 uses a remote control 22 to control multiple devices that are components of a home entertainment system. The devices include a television 24, a set-top box 26, a digital video recorder 28, a videocassette recorder 30, and a stereo system 32. The audiovisual content that is received by and/or displayed on these devices is received over communications network 42 that comes from an audiovisual content provider 44, for example DISH®.

When the user 20 wishes to interact with a device, for example the television 24, the user aims the remote control 22 at the television 24 with the aid of an aiming mechanism that is part of the remote control 22. In some variations of this implementation, the aiming mechanism may be a physical mechanism that the user 20 can sight along such as a marking 22*b* on the top or side of the remote control 22, a laser sighting mechanism 56*a* that will visually indicate the spot at which the remote control 22 is pointing, a peep sight, or some other aiming tool on the remote control 22.

Once properly aimed at the device, the remote control 22 then exchanges signals along a communication path 23, to identify the device. In one implementation, a beacon 24*a* that is in close proximity to the television 24, for example sitting on top of the television 24 housing, within the housing or attached to the front of the television 24 housing, broadcasts signals on a regular basis identifying the device as the television 24. These broadcast signals are received by a directional receiver 22*a* when the remote control 22 is aimed at the television 24. In other implementations, signals are only broadcast from the beacon 24*a* upon the occurrence of an event, such as a detected movement of the remote control 22 or a detection of a low-power laser emitted by the remote control 22. In one implementation, the user will press a button on the remote control 22 and in response the beacon 24*a* outputs a signal.

The directional receiver 22*a* is designed to receive signals over a very narrow field of view. It will only pick up signals from the beacon 24*a* identifying the desired device 24 that the remote control 22 is aimed at and will not pick up signals being sent by other beacons 26*a*, 28*a*, 30*a*, 32*a*. The directional receiver may be implemented in a number of ways depending upon the signal type used. For example, for infrared signals, lenses can be used to narrow the field of view of the receiver 22*a*. For radio-frequency signals, directional antennas can be used to narrow the field of view of the receiver 22*a*.

In some implementations, the signals sent by the beacons 24*a*, 26*a*, 28*a*, 30*a* and 32*a* may include more than identifications of their respective devices. These signals may also include information containing one or more remote control commands that are used to control the respective devices as well as a mapping of these commands to buttons on the remote control 22 keyboard.

FIGS. 2A-2D show non-limiting examples of implementations of a remote control identifying a device at which the remote control is pointed.

Figure 2A:
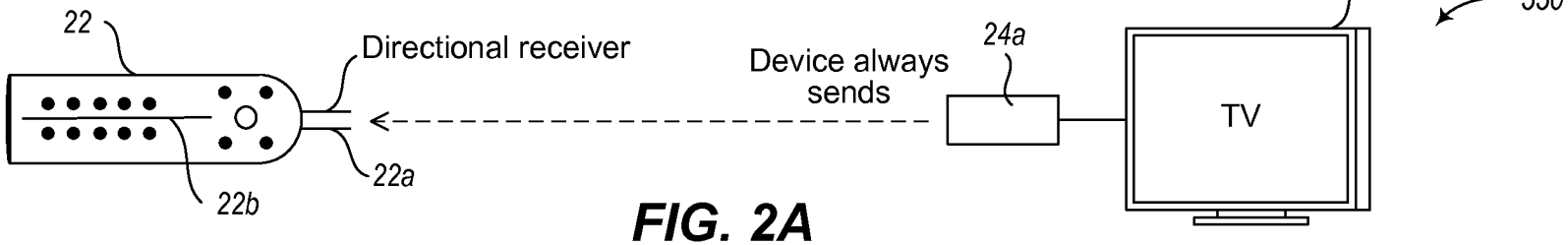
FIG. 2A shows a diagram of one implementation of a remote control identifying a device at which the remote control is pointed and where the device sends a regular identification signal.

FIG. 2A shows a diagram 550 of one implementation of a remote control identifying a device at which the remote control is pointed and where the device sends a regular identification signal. Remote control 22 has a directional receiver 22*a* pointed at a beacon 24*a* that is attached to a device 24, here a television. The sight 22*b* assures the user the remote control 22 is pointed only at the one device, in this case television 24. In this implementation, the beacon 24*a* sends out a regular signal that uniquely identifies the television 24. The signal may be implemented in a number of different forms, including infrared, radio-frequency, Wi-Fi, ultrasound and the like. Here, the directional antenna 22*a* receives the signal from the beacon 24*a* and the remote control 22 analyzes the data in the signal to identify the device 24. Once the device is identified the remote control 22 is able to be configured to send the remote control commands necessary to control the device 24 as explained in more detail herein.

Figure 2B:
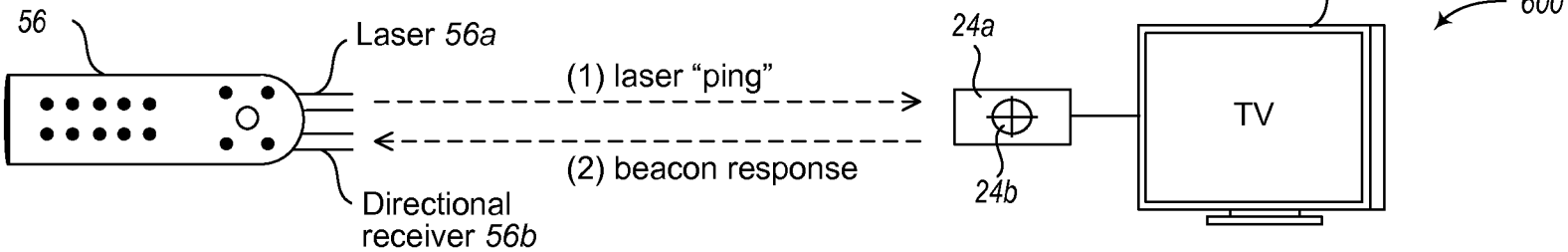
FIG. 2B shows a diagram of one implementation of a remote control identifying a device at which the remote control is pointed by sending a signal to a device and receiving a response identifying the device.

FIG. 2B shows diagram 600 of one implementation of a remote control identifying a device at which the remote control is pointed by sending a signal to the device and receiving a response identifying the device. In this implementation, remote control 56 has a low-power laser 56*a* that is able to send out a request for a signal to beacon 24*a*. The remote control 56 also has a directional receiver 56*b* that is able to receive the signal from beacon 24*a*, which only sends a signal in response to receiving a low-power laser hit on a beacon target 24*b*. When the laser signal hits the target 24*b*, the beacon 24*a* sends an identification signal that is received by the remote control directional receiver 56*b*.

In another implementation that does not involve target 24*b*, the beacon 24*a* sends an identification signal out on a regular basis, and the user 20 uses the low-powered laser signal to visually identify what the remote control 56 is pointed at by looking for the laser "dot" on the device 24.

FIG. 2C shows a diagram 650 of one implementation of a remote control identifying a device at which the remote control is pointed by using a camera within the remote control. A remote control 60 includes camera 60*b* able to capture images of objects at which the remote control 60 is pointed, for example a television 24. In one implementation, a module within the remote control 60 analyzes the captured images and, using visual recognition techniques, is able to identify the device at which the remote control is pointed, for example television 24. The remote control is then configured with commands to control the identified device.

FIG. 2D shows a diagram 700 of one implementation of a remote control that uses position and orientation awareness of the remote control to identify the device at which the remote control is pointed. In one implementation, a module 64*a* within the remote control 64 is able to determine the direction at which a remote control 64 is pointed by determining position and orientation (pitch, yaw and roll measurements) of the remote control 64. In some implementations, the remote control 64 learns the location of each device by having the user 20 point the remote control 64 at each device, for example at the television 24, and identify the device to the remote control 64. Then, using the position and orientation module 64*a*, when the remote control 64 is moved or rotated, it will be configured with the commands that are appropriate to the device at which the remote 64 is pointed. In some situations, the position and orientation information of the remote control 64 will be used to assist other device identification techniques, some of which are described above.

FIGS. 3A-3D show non-limiting example implementations of a remote control receiving and being configured with remote control commands to control an identified device.

Figure 3A:
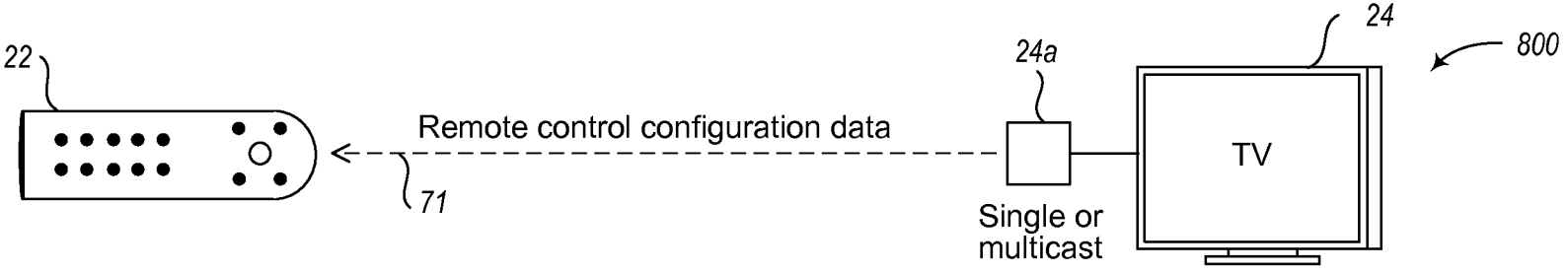
FIG. 3A shows a diagram of one implementation of a remote control being configured to send commands to an identified device.

FIG. 3A shows a diagram 800 of one implementation of a remote control being configured to send commands to an identified device. Here, remote control 22 has determined that it is pointing at television 24 by one or more methods as described above. In this implementation, the beacon 24*a* associated with the television 24 broadcasts remote control configuration data 71. In one or more variations, this configuration data in the signal contains a list of remote control commands that can be received by the device 24, a description of each command, and a mapping of the commands to the buttons or to the other user interface elements of the remote control 22.

In some variations of this implementation, the beacon 24*a* may broadcast a device identifier along with the remote control configuration data 71. This allows remote control 22 both to identify the television 24 and to receive configuration information using the same signal. In other variations, the signal that carries the remote control configuration data 71 may either be regularly broadcast by beacon 24*a*, or be broadcast upon the occurrence of an event such as the movement of the remote control 22, as described above.

Figure 3B:
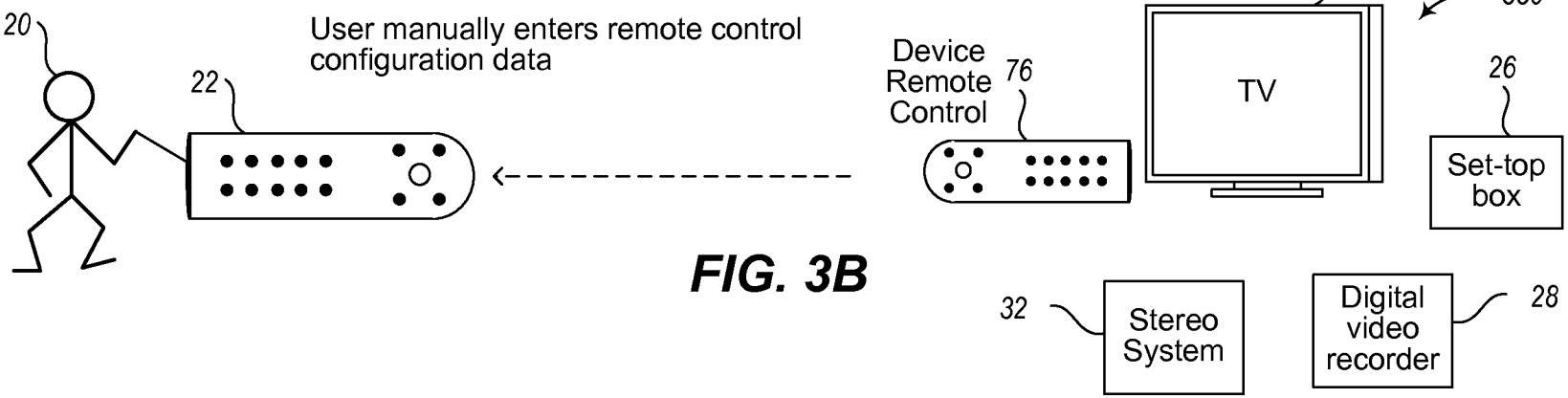
FIG. 3B shows a diagram of a universal remote control being manually configured to send commands to an identified device.

FIG. 3B shows diagram 850 of a universal remote control being manually configured to send commands to an identified device. Here, the user 20 manually configures multiple modes of a universal remote control 22 with the remote control commands associated with controlling multiple devices such as a television 24, a set-top box 26, a digital video recorder 28 and a stereo system 32. After the manual configuration is complete, when the remote control 22 is put into a particular mode, such as a television mode by selecting a television mode button (not shown) on the remote control 22, pressing a button on the remote control 22 will send commands to the television 24.

To configure the remote control 22 this way, the user typically uses a device remote control 76 for an individual device such as a television 24 to program commands into the remote control 22. To do this, the user typically toggles a switch (not shown) on the universal remote control 22 to put it into a programming state. The user 20 then selects a mode button (not shown) on the universal remote control 22 to identify the device to which remote control commands for the device are to be associated. The user 20 then points the device remote control 76 toward the universal remote control 22. While pressing a function button on the device remote control 76 that sends the command to the universal remote control 22, the user 20 presses a button on the universal remote control 22, causing the universal remote control 22 to store that command and associate it with the depressed button on the universal remote control 22.

Once the configuration of the universal remote control 22 is complete for one device, the user 20 selects another mode and repeats the programming process for the next device. The user 20 continues until the remote control commands for all devices 24, 26, 28, 32 are configured into the universal remote control 22. After the universal remote control 22 is configured, device identifiers received from a beacon 24*a* associated with a television 24 cause the remote control 22 to enter the mode for a television 24. This would cause the remote control 22 to send commands to the television 24 until the remote control 22 determined that it was pointing at another device, for example the set-top box 26.

Figure 3C:
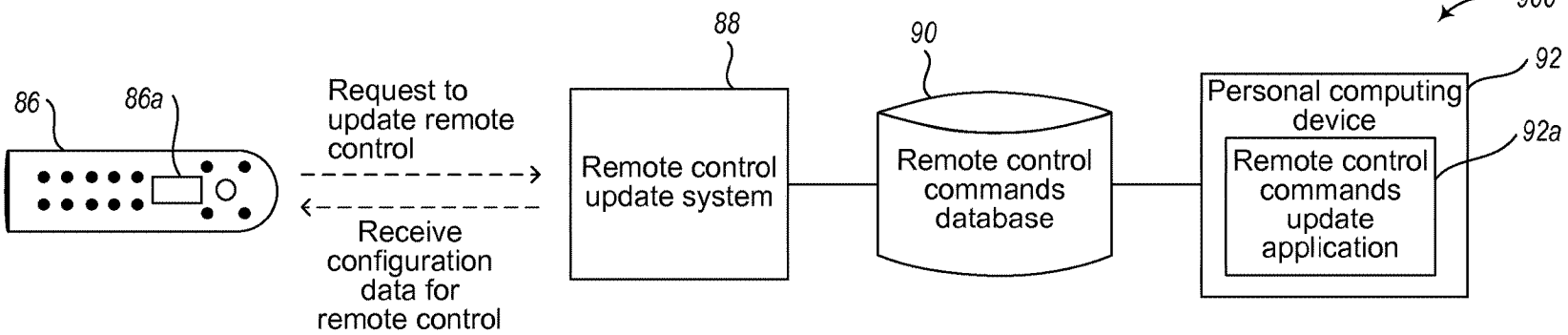
FIG. 3C shows a diagram of a remote control being configured to send commands to an identified device by a system that includes a database containing remote control commands for multiple devices.

FIG. 3C shows diagram 900 of a remote control being configured to send commands to an identified device by a system that includes a database containing remote control commands for multiple devices. Remote control 86 uses a remote control configuration module 86*a* to communicate with a remote control update system 88. The remote control update system 88, in some implementations, may be located in a device including but not limited to a set-top box 26, and may communicate with the remote control 86 in a number of ways including, but not limited to infrared, Bluetooth™, Wi-Fi and the like.

The remote control update system 88 has access to a remote control commands database 90, which is a repository of remote control commands that are associated with multiple devices with which the user 20 may wish to communicate using the remote control 86. In one or more implementations, the remote control commands database 90 also includes mappings of the commands with the buttons on the remote control 86. In one or more variations, mappings may be provided for other remote controls that the user 20 may wish to use. The remote control commands database 90 may be updated using, for example, a personal computing device 92 running an application 92*a* that allows the remote control commands database to be reviewed and updated. In still other implementations, the remote control update system 88 may be updated by a data feed from device manufacturers (not shown). The remote control contains a memory to store the proper commands to control any device. It can obtain these commands from a database as described herein or the device itself may send them along communication path 23.

Figure 3D:
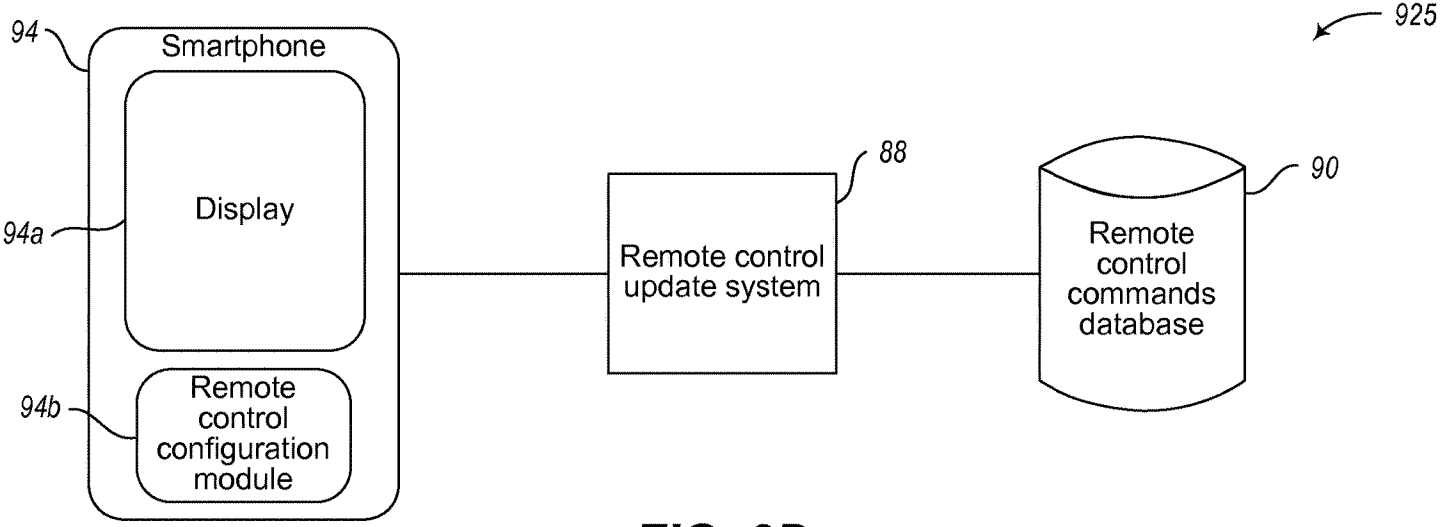
FIG. 3D shows a diagram of a remote control in the form of a smartphone that is configured to send commands to an identified device by a system that includes a database containing remote control commands for multiple devices.

FIG. 3D shows diagram 925 of a remote control in the form of a smartphone that is configured to send commands to an identified device by a system that includes a database containing remote control commands for multiple devices. In this implementation a smartphone 94 is used by user 20 as a remote control 22 to control a device by interacting with a smartphone display 94*a* to select functions or to navigate menu items that send commands to the identified device. In this example, the remote control update system 88 accesses the remote control commands database 90 and provides updated data and/or application software that is received by a remote control configuration module 94*b* to configure the smartphone 94 with an interface and associated functions that allow the user 20 to identify and control a device. In these implementations, the smartphone 94 is configured with an aiming mechanism either as part of the smartphone hardware, including those methods as described above, or as part of the graphical user interface that is part of the smartphone display 94*a*.

Figure 4:
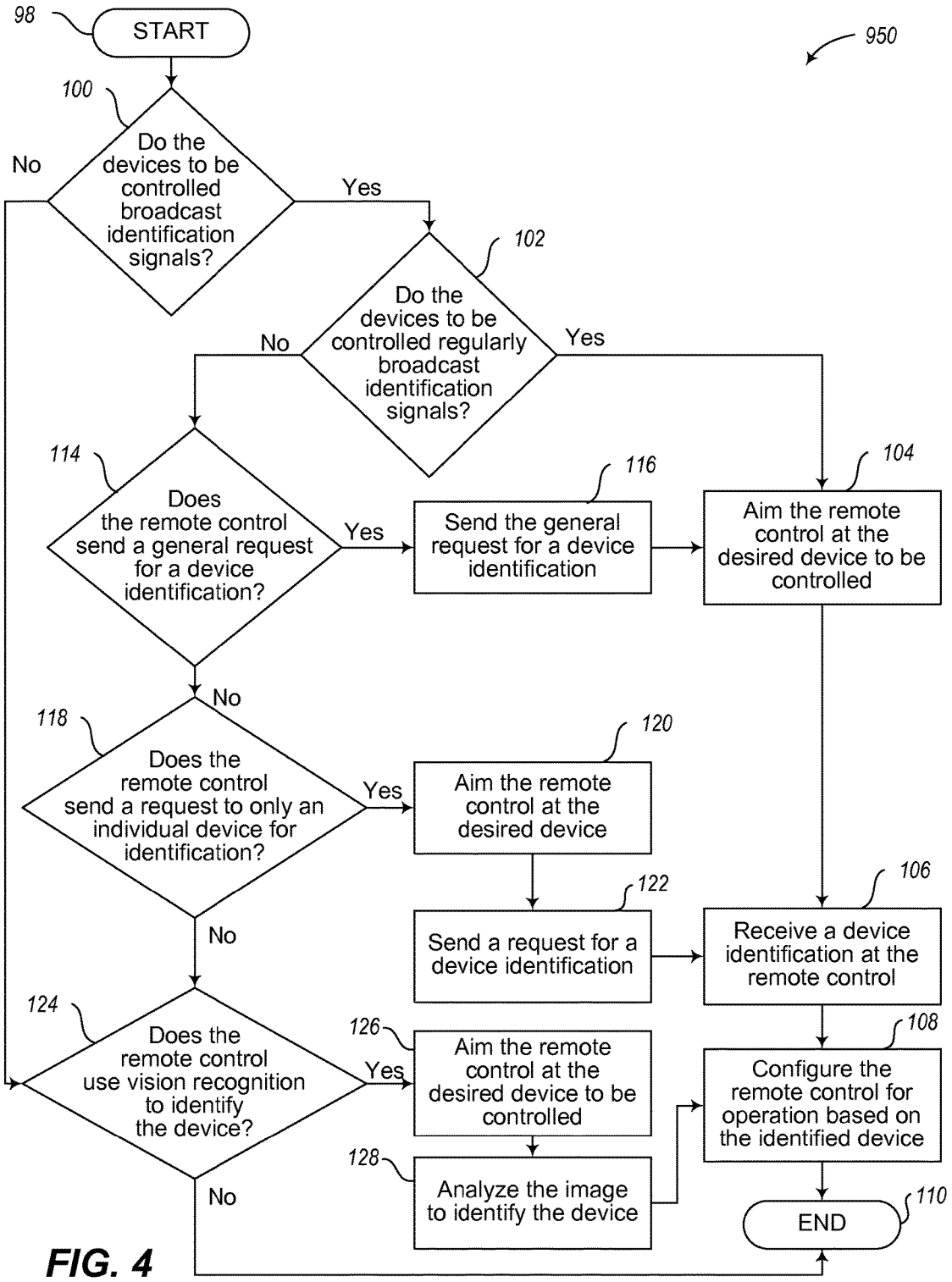
FIG. 4 shows a dataflow diagram that describes one implementation of a method for configuring a remote control based on the device at which the remote control is aimed.

FIG. 4 shows a dataflow diagram that describes one implementation of a method for configuring a remote control based on the device at which the remote control is aimed. At 98, the method starts.

At step 100, the method determines if the devices to be controlled broadcast identification signals. These identification signals are sent by a beacon 24*a* and are received by the directional antenna 22*a* within remote control 22 to identify at which device 24 the remote control 22 is pointed. If the devices to be controlled do not broadcast identification signals, then the method goes to step 124. Otherwise, the method continues.

At step 102, the method determines if the devices to be controlled regularly broadcast identification signals. In some implementations, a device beacon 24*a* will broadcast a signal identifying the device on a regular basis, for example several times a second, for a remote control 22 to receive. This broadcast is independent of any request or signal that comes from the remote control 22. The regular broadcast of the signal may vary based on times of the day, for example the signal may be broadcast more frequently during times when the entertainment system is in higher use, for example during weekday evenings, and less frequently from midnight to early morning hours in order to conserve power. In some implementations, sensors may be used to vary the rate at which the identification signal is broadcast. For example, a motion sensor connected to the device beacon 24*a* that detects movement in proximity to the device when people enter or leave a room, may affect the frequency at which the identification signal is sent. If no motion is detected, the beacon 24*a* may not send any regular signal until motion is detected. In another implementation, the beacon 24*a* may detect identification signals sent from other devices and begin to more frequently broadcast its own identification signals because of the increased likelihood that a user 20 will want to identify the device. If the device to be controlled does not regularly broadcast identification signals, then the method proceeds to step 114.

At step 104, the method has the user aim the remote control at the desired device to be controlled. The aiming is performed with the assistance of aiming techniques and aiming designs associated with the remote control 22. Physical sights on the remote include but are not limited to direction lines on the remote control, back sights and fore sights. Aiming indicators include but are not limited to laser pointers attached to the remote control that indicate where the control is pointing, and indicators on the remote control, such as one or more lights that illuminate or an audible sound that is generated that indicates when the remote control 22 is pointed at a particular device. In addition, if the remote control 22 is implemented as a feature within a smartphone, or has a display with functions similar to a smartphone, the display may be used to indicate the device at which the remote control is pointed. In some variations of the implementation, the display may have a map of the controllable devices in relation to the location of the remote control 22 and an indication on the map to which device the remote control 22 is pointed.

At step 106, the method receives a device identification at the remote control. The device identification may be received in a number of different ways, including a signal sent from a beacon 24*a* that is attached to a device 24. The signal may be one of several types of signals including infrared signals, radio-frequency signals, ultrasound signals and the like. Data contained within the signal at least identifies the device, which is used to determine a set of remote control functions associated with the device. In some implementations the data within the signal may also include the remote control functions themselves, a description of the functions, and a mapping of the functions to the input selections available for the remote control 22. In some implementations, the data may also include a hierarchy or other structure of command menus to be displayed on the remote control display 94*a*.

At step 108, the method configures the remote control for operation based on the identified device. This step associates the remote control commands that are able to control the device 24 with buttons or with other user interface elements used to indicate commands on the remote control 22. These other user interface elements may include turning a knob, making a touch selection on an input screen or speaking a voice command into the remote control 22.

This association may occur in a number of different ways. In one implementation, the commands to control the desired device 24 are received as data that is part of the identification signal received from a beacon 24*a*. In variations of this implementation, the assignment of the commands to buttons or to other user interface elements used to indicate commands on the remote control 22 is also sent as data within the received signal.

In another implementation, a universal remote control 22 has already been programmed by a user 20 with multiple modes where each mode corresponds to a different device that may be controlled by the remote control 22. In this case, the identification signal received in step 106 is used to determine the mode to select within remote control 22 so that it is able to send the proper remote control commands to the desired device 24.

In yet another implementation, the remote control 22, after identifying the desired device in step 106, queries a remote control commands database 90 and retrieves the commands associated with the desired device and assigns those commands to the buttons and other user interface elements of the remote control 22.

After the remote control has been configured, the method ends at 110.

At step 114, the method determines if the remote control sends a general request for a device identification. This step, which happens if the determination at step 102 is no, determines if the remote control 22 sends out a general, wide-broadcast request for a device identification in order to determine at which device the remote control 22 is pointed. If so, then at step 116 the method sends the general request for a device identification, and the method goes to step 104.

Otherwise, at step 118, the method determines if the remote control sends a request to only an individual device for identification. This step, which happens if the determination at step 114 is no, sends a specific request to a device beacon 24*a* in order to receive an identification signal that identifies the device 24. For example, the specific request is sent by using a narrow signal beam, or, as shown in FIG. 2B, by using a low-energy laser to aim at the target 24*b* of device 24. When the narrow beam or the laser hits target 24*b*, the beacon 24*a* will send an identification signal that the remote control 56 is pointing at the device 24.

At step 120, the method has the user aim the remote control at the desired device.

At step 122, the method sends a request for a device identification. For example, if the user 22 aims the low-energy laser beam described in 118 and hits target 24*b*. Then the method goes to step 106.

At step 124, the method determines if the remote control uses vision recognition to identify the device. If so, then at step 126 the method has the user aim the remote control at the desired device to be controlled. In one implementation, as referred to in FIG. 2C, a camera 60*b* with a narrow field of view is included in the remote control 60 and will be pointed in the direction the remote control 60 is aimed. At this point an image is captured. At step 128, the method analyzes the image to identify the device at which the remote control 60 is aimed. This analysis may be done by a vision recognition or a pattern recognition analysis module residing either on the remote control or at a remote location. In some implementations, the analysis module may perform recognition on the known shape and form of each device. In other implementations the analysis module will identify specific patterns, such as a QR code or other unique visual symbol that will identify a device. In some implementations, other uniquely identifiable objects such as vases, clocks, or other objects may be used as a representation for the desired device. The method then goes to step 108 to configure the remote control.

Otherwise, the method ends at 110.

Figure 5:
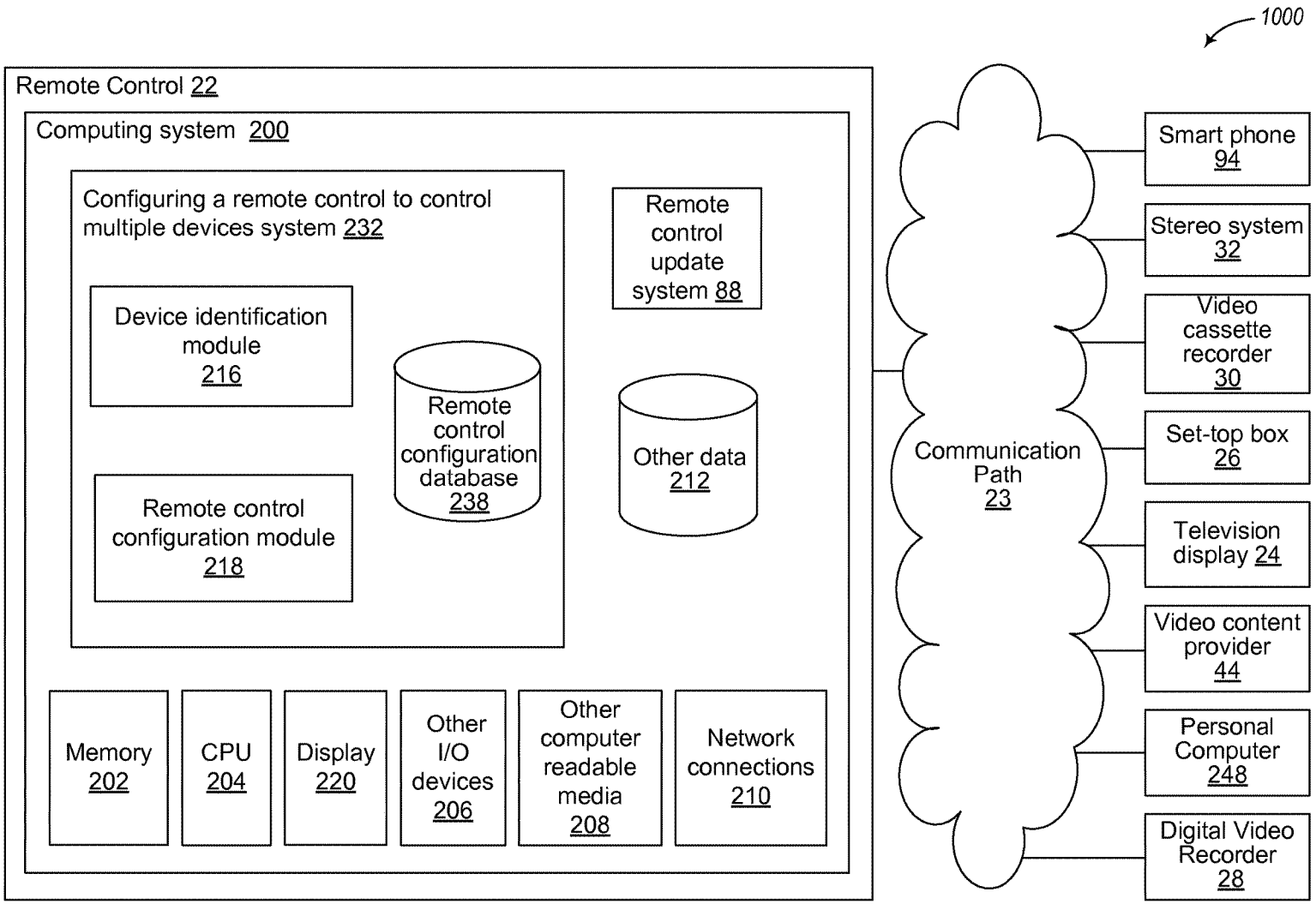
FIG. 5 shows a system diagram that describes one implementation of a computing system for implementing systems and methods for dynamically configuring a remote control for multiple devices.

FIG. 5 shows diagram 1000 of one implementation of a computing system for configuring a remote control to control multiple devices. FIG. 5 includes a computing system 200, which in one variation may be running on a remote control 22 that is utilized to implement configuring a remote control to control multiple devices system 232 with features and functions as described above. One or more general-purpose or special-purpose computing systems may be used to implement the configuring a remote control to control multiple devices system 232. In other variations, the computing system 200 may include one or more distinct computing systems present having distributed locations, such as within a remote control 22, a set-top box 26, a personal computing device 248, or a mobile device such as a smartphone 94. In addition, each block shown may represent one or more such blocks as appropriate to a specific embodiment, or may be combined with other blocks. Moreover, the various blocks of the configuring a remote control to control multiple devices system 232 may physically reside on one or more machines, which may use standard inter-process communication mechanisms (e.g., TCP/IP) to communicate with each other. Further, the configuring a remote control to control multiple devices system 232 may be implemented in software, hardware, and firmware or in some combination to achieve the capabilities described herein.

In the embodiment shown, computing system 200 includes a computer memory 202, a display 220, one or more Central Processing Units ("CPUs") 204, input/output devices 206 (e.g., keyboard, mouse, joystick, track pad, LCD display, smartphone display, tablet and the like), other computer-readable media 208 and network connections 210 (e.g., Internet network connections, infrared receivers and transmitters; radio-frequency receivers and transmitters and the like). In other embodiments, some portion of the contents of some or all of the components of the configuring a remote control to control multiple devices system 232 may be stored on and/or transmitted over other computer-readable media 208 or over network connections 210. The components of the configuring a remote control to control multiple devices system 232 preferably execute on one or more CPUs 204 to facilitate the identification of a device for the remote control to control and the configuration of the remote control to communicate with the device once the device is identified. Other code or programs (e.g., a Web server, a database management system, and the like), and potentially one or more other data repositories 212, also reside in the computing system 200, and preferably execute on one or more CPUs 204. Not all of the components in FIG. 5 are required for each implementation. For example, some embodiments embedded in other software do not provide means for user input, for display, for a customer computing system, or other components. Other implementations, such as remote control functionality within a smartphone 94, may have additional components.

In a typical embodiment, the configuring a remote control to control multiple devices system 232 includes a device identification module 216 and a remote control configuration module 218.

A remote control 22 is used to identify one device, such as a television 24, out of a plurality of devices to be controlled by the remote control 22. In one or more implementations, the device identification module 216 is used to identify the device that the remote control 22 is aimed at so that the remote control 22 is able to control the identified device. The remote control configuration module 218 takes the identification of the device to be controlled and configures the remote control 22 with the remote control functions that can be used to control the identified device, and to map those functions to the appropriate buttons on the remote control 22. In different implementations, the remote control configuration module may receive the set of commands for the identified device, as well as the mapping of those commands to the remote control keyboard, from a signal sent from the identified device or from a remote control configuration database 238 that may reside either within or outside the remote control 22.

Other and/or different modules may be implemented. The configuring a remote control to control multiple devices system 232 also, in some implementations, contains the remote control configuration database 238, which includes information about the remote control commands for multiple devices and, in some implementations, also information about mapping the commands to the remote control buttons and other user interface elements.

The device identification module 216 performs at least some of the functions as described with reference to FIGS. 1, 2A-2D and 4. In particular, the device identification module 216 allows the remote control 22 to identify a specific device among the plurality of devices at which the remote control 22 is aimed. In one or more implementations, the aiming mechanism is integrated into the physical design of the remote control 22 and takes the form of sighting or alignment marks on the remote control body, or in some implementations as a laser or some other visual marker that emanates from the remote control 22 to identify the spot at which it is pointed. In other implementations, aiming information may be displayed on the display 94*a* of the remote control 94.

If the remote control 22 is aimed at a device 24, and more particularly at beacon 24*a* associated with the device, a directional receiver 22*a* that is part of the remote control 22 will receive a signal from the beacon 24*a*. By analyzing the signal, the remote control 22 can determine the device at which it is pointed. The directional receiver 22*a* may work with a number of different signal types including infrared, radio-frequency, and other such technologies used to send signals from one point to another. The directional receiver 22*a* is implemented in such a way that there is a narrow field of view in which a signal will be received by the receiver. This way, the user 20 who aims the remote control 22 at one of two devices that are adjacent to each other can be confident from which device the remote control 22 is receiving signals. For infrared-based signals, this may involve a series of lenses that are part of the directional receiver 22*a* that are used to focus the direction from which infrared signals may be received. For radio-frequency based signals, this may involve a series of directional antennas. In some implementations, signals may be continuously emitted by all beacons associated with each device, and the remote control 22 is able to determine the appropriate device by receiving only the signals coming from the direction in which the remote control 22 is aimed.

In other implementations, the remote control 22 may emit a laser that is detected by a target which, in different variations, may or may not be a part of a beacon 24*a* associated with a device 24. In these implementations, the detection of the laser by the beacon 24*a* will signal the beacon 24*a* to transmit an identifying signal associated with its device 24. This way, signals identifying each device do not need to be continuously sent. Similarly, in some implementations the movement of the remote control 22 is used to trigger the beacons of one or more devices to send a signal identifying each device.

In other implementations, the remote control 22 may have a camera embedded within the remote control that captures images of devices at which the remote control 22 is pointed. An image processing or visual recognition module either in or associated with the remote control 22 analyzes the captured images and determines whether the remote control is aimed at a device which may be controlled by the remote control 22. In other implementations, mechanisms within the remote control 22 that can identify the position and orientation of the remote control 22 can be used to determine the device at which the remote control 22 is pointed.

In some implementations, the type of signals sent by a beacon 24*a* may be different than the types of signals sent by the remote control 22 to control the device. For example, the beacon 24*a* may send a radio-frequency signal that is received by the remote control 22, and the remote control 22 may send an infrared signal to control the device 24.

In addition, in some implementations, the remote control 22 will indicate which device it is aimed at by, for example, displaying one or more lights or other visual indications on the remote control 22 associated with the device 24, emitting a sound that identifies the device 24, or, if the remote control 22 is a smartphone 94 or similar device, displaying the name of the device 24 at which the remote control 94 determines it is pointed at on the smartphone display 94*a*.

The remote control configuration module 218 performs at least some of the functions as described with reference to FIGS. 1, 3A-3D and 4. In particular, the remote control configuration module 218 provides the remote control 22 with the proper commands to control the device at which it is pointed, as well as to map those commands to buttons or to other user interface elements that are part of the remote control 22.

In some implementations, a beacon 24*a* associated with the television 24, in addition to sending a signal that identifies the device 24, also sends the remote control commands that are available to control the device 24. For example, the beacon 24*a*, in addition to sending an identification of the television 24, may send the remote control commands for "volume up", "volume down", "off", and "on" within the signal. The remote control configuration module 218 will identify these commands and associate them with the volume up, volume down, off and on buttons of the remote control 22. Then, when the user 20, presses the volume up command, the remote control 22 will send the volume up command to the television 24.

In other implementations, the user 20 manually enters in remote control commands for each of the possible devices to be selected into a universal remote control 22 that has multiple modes corresponding to each of the possible devices that it can control. This is done as described in FIG. 3B above. In this and related implementations, when the universal remote control 22 identifies a particular device to be controlled, the remote control will switch into the mode that is associated with controlling that device. Once the mode is switched, the button presses on the universal remote control 22 will be sent to the device 24 until the mode is switched again, for example by pointing the universal remote control 22 at a different device.

In still other implementations, once the remote control 22 has identified the device at which it is aimed, the remote control 22 will query a remote control update system 88 to receive a list of remote control commands that are associated with the identified device. The remote control update system 88 has access to the remote control configuration database 238, where the remote control configuration module 218 receives the remote control commands and other data needed to configure the remote control 22. In some variations, a personal computing device 92 runs an application 92*a* that communicates with and updates the remote control commands database 90. In some implementations, this database update may be done on a regular basis by a process that searches for and includes remote control commands for all popular devices that may be controlled by remote control 22. In some variations, this information is received from device manufacturers.

In some implementations, the configuration of the remote control 22 will change as soon as a remote control 22 is no longer pointing at an identified device 24. In other implementations, the configuration of the remote control 22 will remain in effect until the remote control 22 is pointed at a new device which it can identify and configure itself to control. In still other implementations, an indication on the remote control 22, such as a button press, can lock the remote control into the current configuration until the user 20 either indicates through another remote control interaction that the configuration should be reset, or a set period of time elapses.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method comprising:

aiming a wireless remote control at one device of a plurality of devices that are able to be controlled by the remote control, the remote control having a plurality of buttons at least one of which, when activated, transmits a command from the remote control to the device;

identifying, based on the aiming of the wireless remote control, the device of the plurality of devices at which the wireless remote control is aimed;

determining, based on the identified device, a plurality of remote control commands that may be sent to the identified device;

configuring, based on the identified device and the determined remote control command, the remote control for use with the identified device, the configuring including associating two or more of the plurality of buttons of the remote control with the determined remote control commands;

after configuring the remote control for use with the identified device, receiving an indication of a button press to keep the remote control configured for use with the identified device;

in response to receiving the indication of the button press, keeping the remote control configured for use with the identified device until a sequence of the remote control commands is sent to the identified device;

sending the sequence of the remote control commands from the remote control to the identified device; and in response to sending the sequence of the remote control commands from the remote control, resetting a configuration of the remote control.

2. The method of claim 1, wherein identifying the device of the plurality of devices further includes:

receiving, by the remote control, a signal identifying the device, the receiving performed in part by using a directional receiver.

3. The method of claim 2, wherein the signal is one of an infrared and a radio-frequency signal.

4. The method of claim 2, wherein determining the remote control command that may be sent to the identified device further includes:

receiving, by the remote control, a remote control command from the identified device.

5. The method of claim 1, wherein sending a signal requesting a device identification further includes initiating the sending based on movement of the remote control.

6. The method of claim 1, wherein sending a signal requesting a device identification further includes one of:

transmitting, by the remote control, a laser beam to a detector associated with the device;

transmitting, by the remote control, a radio-frequency signal;

transmitting, by the remote control, an infrared signal.

7. The method of claim 1, wherein receiving a signal identifying the device further includes receiving the signal using a directional receiver.

8. The method of claim 1, wherein determining the remote control command that may be sent to the identified device further includes:

receiving, by the remote control, a remote control command from the identified device.

9. The method of claim 1, wherein determining the remote control command that may be sent to the identified device further includes:

retrieving, from a database, a remote control command that may be sent to the identified device.

10. The method of claim 1, wherein, wherein identifying the device of the plurality of devices at which the wireless remote control is aimed includes:

sending, by the remote control, a signal requesting a device identification; and receiving, by the remote control, a signal identifying the device that is sent by the device in response to the device receiving the signal requesting the device identification.

11. An apparatus, comprising:

a wireless remote control;

an aiming mechanism that is part of the remote control, the aiming mechanism enabling a user to aim the remote control at a device of a plurality of devices;

an input/output mechanism that is part of the remote control and coupled to the aiming mechanism, the input/output mechanism enabling the remote control to receive and send signals;

a processor that is part of the remote control and coupled to the input/output mechanism;

a non-transitory memory that is coupled to the processor; and a module running on the non-transitory memory that is configured to, when executed by the processor:

identify the device of the plurality of devices at which the wireless remote control is aimed, determine, based on the identified device, a plurality of remote control commands that may be sent to the identified device, configure, based on the identified device and the determined remote control commands, the remote control for use with the identified device, including associate a plurality buttons of the remote control with the remote control command that may be sent to the identified device, after the remote control is configured for use with the identified device, receive an indication of a button press to keep the remote control configured for use with the identified device;

in response to receiving the indication of the button press, keep the remote control configured for use with the identified device until a sequence of the remote control commands is sent to the identified device;

send the sequence of the remote control commands to the identified device; and in response to sending the sequence of the remote control commands from the remote control, reset a configuration of the remote control.

12. The apparatus of claim 11, wherein identify the device of the plurality of devices further includes:

receive, by the input/output mechanism, a signal that identifies the device, wherein the input/output mechanism includes a directional receiver.

13. The apparatus of claim 12, wherein the signal is one of an infrared and a radio-frequency signal.

14. The apparatus of claim 12, wherein determine the remote control command that may be sent to the identified device further includes receive, by the input/output mechanism, the remote control command from the identified device.

15. The apparatus of claim 11, wherein identify the device of the plurality of devices further includes:

send, by the input/output mechanism, a signal requesting a device identification;

receive, by the input/output mechanism in response to the sent signal, a signal identifying the device.

16. The apparatus of claim 15, wherein send a signal requesting a device identification further includes send the signal in response to a movement of the remote control.

17. The apparatus of claim 15, wherein send a signal requesting a device identification further includes one of:

transmit, by the input/output mechanism, a laser beam to a detector associated with the device;

transmit, by the input/output mechanism, a radio-frequency signal;

transmit, by the input/output mechanism, an infrared signal.

18. The apparatus of claim 15, wherein receive a signal identifying the device further includes receive the signal using a directional receiver.

19. The apparatus of claim 15, wherein determine the remote control command that may be sent to the identified device further includes receive, by the input/output mechanism, a remote control command from the identified device.

20. The apparatus of claim 15, wherein determine the remote control command that may be sent to the identified device further includes retrieve, from a database, a remote control command that may be sent to the identified device.

* * * * *